US009650190B2

(12) United States Patent
Lee et al.

(10) Patent No.: US 9,650,190 B2
(45) Date of Patent: May 16, 2017

(54) ACCOMMODATING DEVICE FOR DIFFERENT TYPES OF MATERIAL

(71) Applicant: Su-Jae Lee, Seoul (KR)

(72) Inventors: Seong-Jae Lee, Seoul (KR); Jeong-Min Lee, Seoul (KR)

(73) Assignee: Su-Jae Lee, Seoul (KR)

( * ) Notice: Subject to any disclaimer, the term of this patent is extended or adjusted under 35 U.S.C. 154(b) by 16 days.

(21) Appl. No.: 14/422,140

(22) PCT Filed: Feb. 12, 2013

(86) PCT No.: PCT/KR2013/001067
§ 371 (c)(1),
(2) Date: Feb. 17, 2015

(87) PCT Pub. No.: WO2013/119088
PCT Pub. Date: Aug. 15, 2013

(65) Prior Publication Data

US 2015/0203261 A1 Jul. 23, 2015

(30) Foreign Application Priority Data

Feb. 9, 2012 (KR) ..... 10-2012-0013496
Feb. 10, 2012 (KR) ..... 10-2012-0014003
Feb. 13, 2012 (KR) ..... 10-2012-0014054

(51) Int. Cl.
*B65D 51/28* (2006.01)
*B65D 1/02* (2006.01)
(Continued)

(52) U.S. Cl.
CPC ..... *B65D 51/2821* (2013.01); *B65D 1/0238* (2013.01); *B65D 1/0246* (2013.01);
(Continued)

(58) Field of Classification Search
CPC B65D 51/2821; B65D 51/285; B65D 1/0238; B65D 1/0246
See application file for complete search history.

(56) References Cited

U.S. PATENT DOCUMENTS 6,148,996 A * 11/2000 Morini ..... B65D 51/285 206/222
2003/0132244 A1* 7/2003 Birkmayer ..... B65D 41/3442 222/83

(Continued)

*Primary Examiner* — Anthony Stashick
*Assistant Examiner* — James Way
(74) *Attorney, Agent, or Firm* — Fay Kaplun & Marcin, LLP

(57) ABSTRACT

Provided is an accommodating device for different materials, which includes a fixed part fixed around a container neck and an operating part disposed around the fixed part and coupled thereto. An accommodating part having a storage space extends downward within the operating part, and a lower end part and an outer ring-shaped part of the accommodating part are sealed by a sealing support part and a sealing part of the fixed part disposed around the container neck and coupled thereto. In the accommodating part, a tab for breaking perforations, which is formed on a lower end of the accommodating part of the operating part, breaks the perforations formed between the sealing support part and the sealing part when a consumer rotates the operating part. During this process, a protrusion part protruding from the upper side of the sealing part is pushed downward by a side protrusion piece of the operating part so that the different type of material stored in the storage space of the accommodating device falls into the container and undergoes a mixing process. The sealing support part disposed around the outer ring-shaped part of the accommodating part and coupled thereto and the sealing part formed inside the sealing support part are configured such that an inner ring-shaped part of the sealing part tightly contacts an inner (Continued)

wall part of the lower end of the accommodating part so as to maintain sealing force thereof.

18 Claims, 7 Drawing Sheets

(51) Int. Cl.
*B65D 53/02* (2006.01)
*B65D 81/32* (2006.01)

(52) U.S. Cl.
CPC ..... *B65D 51/285* (2013.01); *B65D 53/02* (2013.01); *B65D 81/3283* (2013.01); *B65D 2501/0054* (2013.01)

(56) References Cited

U.S. PATENT DOCUMENTS

2008/0093326 A1* 4/2008 Cho ..... B65D 51/285 215/228
2008/0202949 A1* 8/2008 Morini ..... B65D 51/285 206/219
2010/0059394 A1* 3/2010 Fontana ..... B65D 51/2814 206/222
2012/0325697 A1* 12/2012 Cho ..... B65D 51/285 206/219

* cited by examiner

ACCOMMODATING DEVICE FOR DIFFERENT TYPES OF MATERIAL

TECHNICAL FIELD

The present invention relates to an accommodating device for different types of material, which is configured such that while an operating part rotates about a main body, a side protrusion piece opens a sealing part sealing a storage space of an accommodating part.

BACKGROUND ART

The present invention relates to a technology improved from a technology disclosed in U.S. Pat. No. 7,337,921.

DISCLOSURE OF THE INVENTION

Technical Problem

U.S. Pat. No. 7,337,921 discloses a technology in which a perforation guide part breaks a perforation surface of an accommodating part such that a material accommodated in the accommodating part falls into a container and undergoes a mixing process. However, when a perforation part of the perforation surface is weak, barrier performance may be poor. On the contrary, when the perforation part of the perforation surface is strong, it may be difficult to break the perforation part.

In addition, PCT No. PCT/EP02/04523 (originated from Germany) discloses a technology in which: while a cap is opened, a perforation surface of an accommodating part is broken such that a material stored in a storage space falls into a container and undergoes a mixing process; and when the cap is further opened, the accommodating part is removed from a bottle neck. However, since a perforation part is week, a recess or protrusion should be formed on the bottle neck in order to prevent the accommodating part from spinning with no traction around the bottle neck and to break the perforation surface.

The present invention relates to a technical modification from the above described technologies, and an object of the present invention is to store a material in a storage space of an accommodating part for a long time by sealing the lower end part of the storage space through a sealing part.

Technical Solution

In one embodiment, an accommodating device for different types of material, which is coupled to a container in a discharge direction of a material contained in the container, includes a fixed part fixed around a container neck, and an operating part disposed around the fixed part and coupled thereto, wherein: an accommodating part having a storage space extends downward within the operating part; the storage space of the accommodating part stores a different type of material such as a liquid, powder, granules, or a tablet; a lower end part and an outer ring-shaped part of the accommodating part are sealed by a sealing support part and a sealing part of the fixed part disposed around the container neck and coupled thereto; a tab for breaking perforations, which is formed on a lower end of the accommodating part of the operating part, breaks perforations formed between the sealing support part and the sealing part when a consumer rotates the operating part; and during the breakage of the perforations, a protrusion part protruding from the upper side of the sealing part is pushed downward by a side protrusion piece of the operating part so that the different type of material stored in the storage space of the accommodating device falls into the container and undergoes a mixing process.

The sealing support part disposed around the outer ring-shaped part of the accommodating part and coupled thereto and the sealing part formed inside the sealing support part are configured such that an inner ring-shaped part of the sealing part tightly contacts an inner wall part of the lower end of the accommodating part so as to maintain sealing force thereof.

A stop piece may protrude a predetermined length above the sealing part.

An end part of the stop piece may be caught and fixed by the sealing support part or the lower end part of the accommodating part.

In another embodiment, an accommodating device for different types of material, which is coupled to a container in a discharge direction of a material contained in the container, includes a fixed part fixed around a container neck, and an operating part disposed around the fixed part and coupled thereto, wherein: an accommodating part having a storage space extends downward within the operating part; and the storage space of the accommodating part stores a different type of material such as a liquid, powder, granules, or a tablet.

A lower end part and an outer ring-shaped part of the accommodating part are sealed by a sealing support part and a sealing part of the fixed part disposed around the container neck and coupled thereto; a tab for breaking perforations, which is formed on a lower end of the accommodating part of the operating part, breaks perforations formed between the sealing support part and the sealing part when a consumer rotates the operating part; and during the breakage of the perforations, a protrusion part protruding from the upper side of the sealing part is pushed downward by a side protrusion piece of the operating part so that the different type of material stored in the storage space of the accommodating device falls into the container and undergoes a mixing process.

A main body spout outer ring-shaped protrusion is disposed on an outer ring-shaped part of a main body spout at a lower end part thereof; a guide surface having an inclined shape is disposed on a portion of the main body spout outer ring-shaped protrusion; and a screw thread having a guide screw thread is formed above the guide surface.

The operating part may include a ring-shaped protrusion and a guide part; and while the ring-shaped protrusion caught by the main body spout outer ring-shaped protrusion rotates along a predetermined circle and is then moved upward by resistance from a guide surface, the guide part may rotate on the guide screw thread along the screw thread, and simultaneously, the operating part may move out of the main body spout.

In another embodiment, an accommodating device for different types of material, which is coupled to a container in a discharge direction of a material contained in the container, includes a fixed part fixed around the inside of a container neck, and an operating part disposed around the fixed part and coupled thereto, wherein: an accommodating part having a storage space extends downward within the operating part; and the storage space of the accommodating part stores a different type of material such as a liquid, powder, granules, or a tablet.

A hoop of an outer ring-shaped part of the fixed part at an upper end thereof is caught by a coupling protrusion of the operating part and is coupled thereto; the accommodating part is sealed by a sealing support part and a sealing part of the fixed part; a tab for breaking perforations, which is formed on a lower end of the accommodating part of the operating part, breaks perforations formed between the sealing support part and the sealing part when a consumer rotates the operating part; and during the breakage of the perforations, a protrusion part protruding from the upper side of the sealing part is pushed downward by a side protrusion piece of the operating part so that the different type of material stored in the storage space of the accommodating device falls into the container and undergoes a mixing process.

The sealing part tightly contacts and seals a lower end part of the accommodating part of the operating part.

The sealing part may be inserted in an inner wall part of the accommodating part as the lower end thereof, thereby sealing the lower end part of the accommodating part.

In another embodiment, an accommodating device for different types of material, which is coupled to a container in a discharge direction of a material contained in the container, includes a fixed part fixed around the inside of a container neck, and an operating part disposed around the fixed part and coupled thereto, wherein: an accommodating part having a storage space extends downward within the operating part; and the storage space of the accommodating part stores a different type of material such as a liquid, powder, granules, or a tablet.

A hoop of an outer ring-shaped part of the fixed part at an upper end thereof is caught by a coupling protrusion of the operating part and is fixedly coupled thereto; the accommodating part is sealed by a sealing support part and a sealing part of the fixed part; and a tab for breaking perforations, which is formed on a lower end of the accommodating part of the operating part, breaks perforations formed between the sealing support part and the sealing part when a consumer rotates the operating part.

During the breakage of the perforations, a protrusion part protruding from the upper side of the sealing part is pushed downward by a side protrusion piece of the operating part so that the different type of material stored in the storage space of the accommodating device falls into the container and undergoes a mixing process; and an upper end of the accommodating part extends upward, and an outer ring-shaped part of the accommodating part is divided by separating perforations such that the outer ring-shaped part is separated from a portion of the operating part.

The sealing part may be fitted in an inner wall part of the accommodating part at a lower end part thereof, thereby sealing the storage space of the accommodating part.

The separating perforations may be formed at the inside of the operating part, where the coupling protrusion is disposed, such that the hoop formed on the outer ring-shaped part of the fixed part is prevented from being removed from the coupling protrusion of the operating part.

A fixing protrusion may be formed on the outer ring-shaped part of the accommodating part and be disposed around an inner wall part of the fixed part and coupled thereto.

A handle having two or more protruding surfaces or a tap may be formed on an upper outer ring-shaped part of the operating part.

The accommodating part may extend upward, and various figures such as a miniature or character may be assembled on or coupled to an upper outer ring-shaped part of the accommodating part.

Advantageous Effects

An inner ring-shaped part of a sealing part tightly contacts an inner wall part of the lower end of an accommodating part having a storage space, so as to maintain sealing force thereof, thereby significantly improving sealing force of the storage space.

BEST MODE FOR CARRYING OUT THE INVENTION

Figure 1:
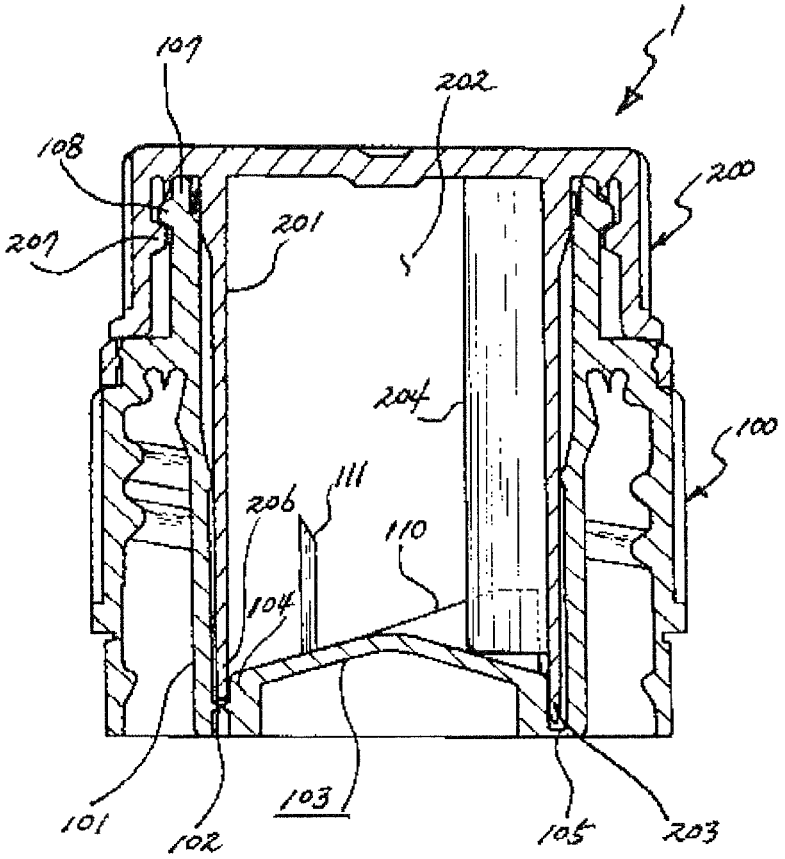
FIG. 1 is a vertical cross-sectional view illustrating an accommodating device according to a first embodiment of the present invention.

An accommodating device 1 for different types of material, which is coupled to a container in a discharge direction of a material contained in the container, includes a fixed part 100 fixed around a container neck, and an operating part 200 disposed around the fixed part 100 and coupled thereto. An accommodating part 201 having a storage space 202 extends downward within the operating part 200, and the storage space 202 of the accommodating part 201 stores a different type of material such as a liquid, powder, granules, or a tablet.

A lower end part and an outer ring-shaped part of the accommodating part 201 are sealed by a sealing support part 101 and a sealing part 103 of the fixed part 100 disposed around the container neck and coupled thereto. The accommodating device 1 is configured such that a tab 203 for breaking perforations, which is formed on a lower end of the accommodating part 201 of the operating part 200, breaks perforations 102 formed between the sealing support part 101 and the sealing part 103 when a consumer rotates the operating part 200.

A side protrusion piece 204 having a predetermined size is elongated downward from a bottom surface of the operating part 200 at the upper side thereof and is formed on an inner wall part of the accommodating part 201.

The side protrusion piece 204 is provided with a protrusion part 110 that is disposed on the upper side of the sealing part 103 and that protrudes upward near the perforations 102. In addition, the protrusion part 110 is configured to be pushed downward by resistance from the side protrusion piece 204.

The sealing support part 101 disposed around the outer ring-shaped part of the accommodating part 201 and coupled thereto and the sealing part 103 formed inside the sealing support part 101 are configured such that an inner ring-shaped part 104 of the sealing part 103 tightly contacts an inner wall part 206 of the lower end of the accommodating part 201 so as to maintain sealing force thereof.

A connecting part 105 is formed between the sealing support part 101 and the sealing part 103, and the perforations 102 are formed in outer ring-shapes at both sides of the connecting part 105.

The perforations 102 may be provided in the form of recesses or cut gaps, or an auxiliary sealing part such as aluminum foil may be adhered to the lower part of a cut area of the perforations 102.

The perforations 102 are formed in outer ring-shaped parts at both sides of an upper recess 106 of the connecting part 105 and gradually increase in height from the upper recess 106.

The sealing part 103 may protrude upward or be configured such that a sealing surface protrude upward in a circular shape from a plane to seal the inner wall part 206 of the accommodating part 201. The protrusion part 110 is formed on the upper side of the sealing part 103 having a protruding form.

The protrusion part 110 may be close to an area where the perforations 102 start and end, that is, a side area where the upper recess 106 of the connecting part 105 is disposed, and is maximally close to the perforations 102 to form a predetermined circle.

A stop piece 111 protrudes (extends) a predetermined length above the sealing part 103. While the stop piece 111 is opened along a predetermined circle, an end part of the stop piece 111 is caught by an end part of the accommodating part 201 or an end part of the sealing support part 101 so as to prevent the stop piece 111 from returning to an original position thereof.

A principle as described above can be used as a case that the fixed part 100 has a capsule form to be inserted into the operating part 200. In this case, while the operating part 200 is caught and fixed by a wedge-shaped recess formed in an upper end of an inner wall of the container neck, the operating part 200 rotates to break the sealing part 103. Such a basic technology would be easy to understand with reference to PCT/EP02/04523.

For reference, a main body spout 107 including a main body spout outer ring-shaped protrusion 108 is formed in the upper part of the fixed part 100, and a ring-shaped protrusion 207 of the operating part 200 is disposed around the main body spout 107 and is caught and fixed thereby.

In a usage process according to the present invention as described above, when the operating part 200 is rotated in a state as illustrated in FIG. 1, while the tab 203 disposed in the upper recess 106 having a predetermined depth is removed from the upper recess 106, the perforations 102 formed at a predetermined height in the upper recess 106 start to be broken by resistance from the tab 203.

Figure 2:
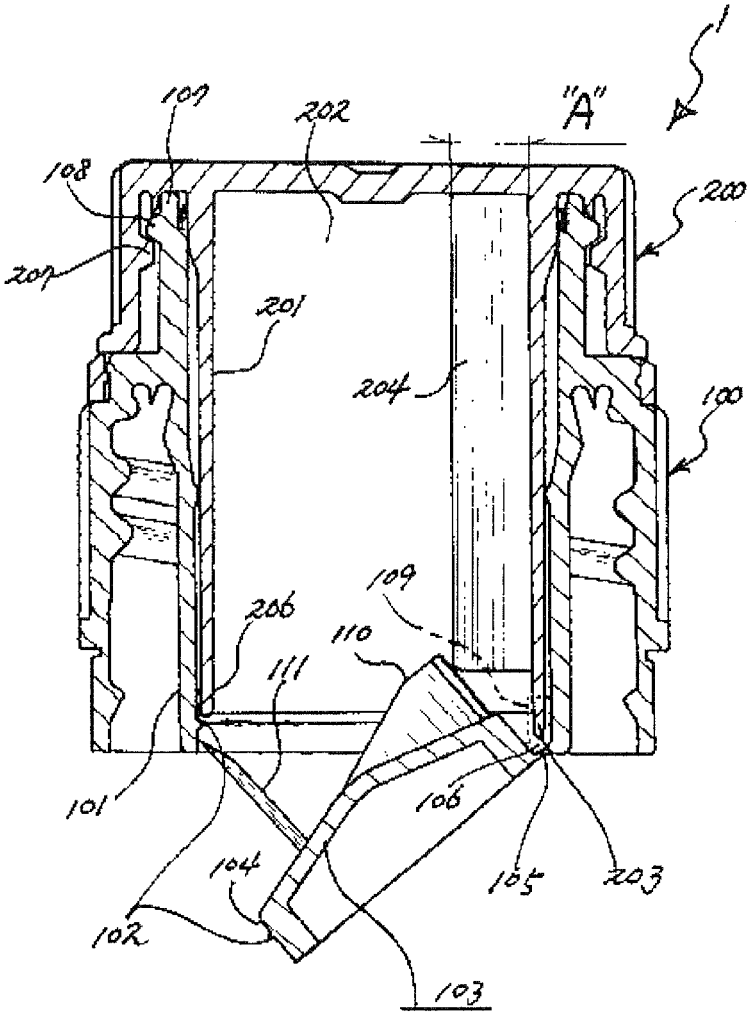
FIG. 2 is a vertical cross-sectional view illustrating a sealing part that is opened by an operation of an operating part in a state as illustrated in FIG. 1, according to the first embodiment.

At this point, the lower end part of the side protrusion piece 204 approaches the protrusion part 110 formed on the upper side of the sealing part 103, and then, the protrusion part 110 having a predetermined inclination angle is gradually pushed down by the lower end part of the side protrusion piece 204 to open the storage space 202 as illustrated in FIG. 2.

The sealing part 103 that is also opened cannot return upward since the protrusion part 110 is further pushed down by the lower end part of the side protrusion piece 204.

The tab 203 rotates along a circle through an angle approaching about 360 degrees and is then caught by a stopper 109 formed on an inner wall part of the sealing support part 101 around the upper recess 106, so that the tab 203 is prevented from further rotating and is stopped.

For reference, as illustrated in FIG. 2, a size A of the side protrusion piece 204 is adjustable, and the perforations 102 may be shaped from a soft resin through injection molding by a double injection molding device or be shaped by forming a surface of the inner ring-shaped part 104 from a soft resin through double injection molding.

Figure 3:
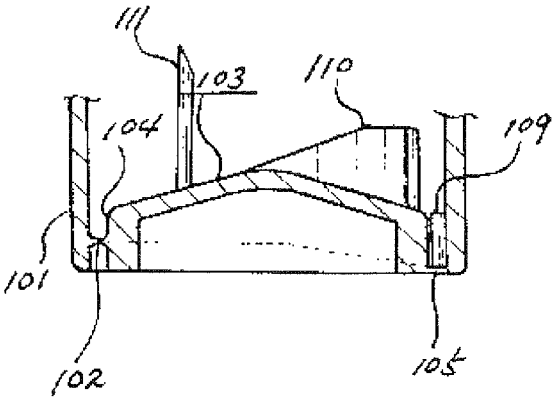
FIG. 3 is a vertical cross-sectional view illustrating a principal part around the sealing part according to the first embodiment.

The sealing support part 101 and the sealing part 103 are described with reference to FIG. 3. Referring to FIG. 3, the stopper 109 is formed in the upper recess 106 illustrated in FIG. 2, and the tab 203 of the operating part 200 is disposed at the front side of the stopper 109 and is coupled thereto.

Figure 4:
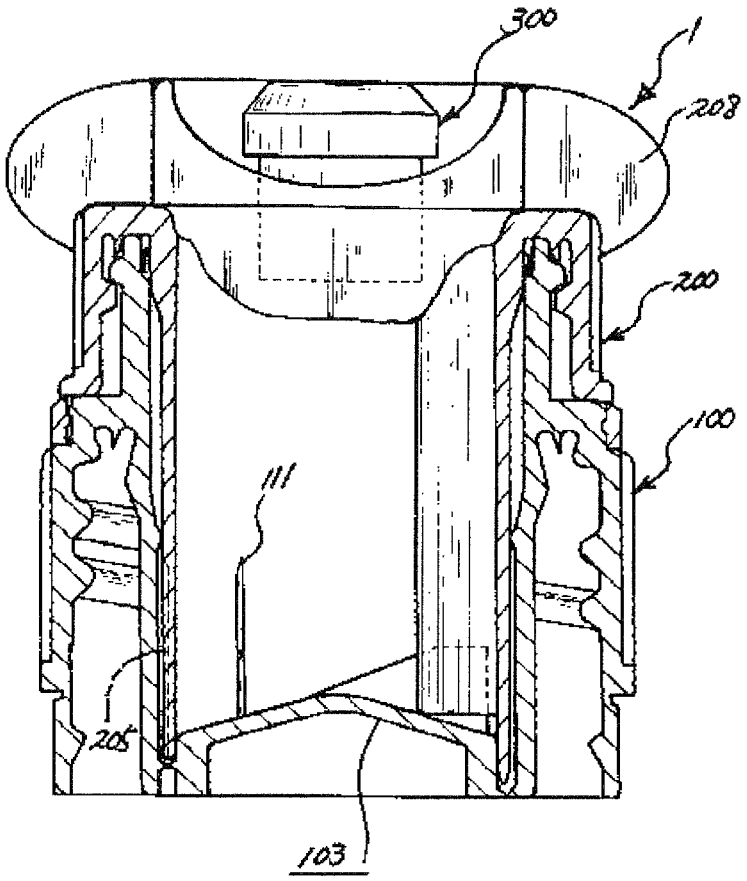
FIG. 4 is a vertical cross-sectional view illustrating a modification of the accommodating device of FIG. 1.

Referring to FIG. 4, an air recess 205 is formed to prevent air from being compressed in the operating part 200 and the fixed part 100 while the operating part 200 is coupled to the fixed part 100.

A discharge part 300 is formed at the upper side of the operating part 200 to discharge a mixture contained in the container. In the usage process, the discharge part 300 disposed in a handle 208 is raised to open an opening and closing hole.

Since a system of the discharge part 300 is well known in the art, a detailed illustration thereof is omitted.

According to an embodiment (refer to FIG. 5), an accommodating device 1 for different types of material, which is coupled to a container in a discharge direction of a material contained in the container, includes a fixed part 100 fixed around a container neck, and an operating part 200 disposed around the fixed part 100 and coupled thereto. An accommodating part 201 having a storage space 202 extends downward within the operating part 200, and the storage space 202 of the accommodating part 201 stores a different type of material such as a liquid, powder, granules, or a tablet.

A lower end part and an outer ring-shaped part of the accommodating part 201 are sealed by a sealing support part 101 and a sealing part 103 of the fixed part 100 disposed around the container neck and coupled thereto. The accommodating device 1 is configured such that a tab 203 for breaking perforations, which is formed on a lower end of the accommodating part 201 of the operating part 200, breaks perforations 102 formed between the sealing support part 101 and the sealing part 103 when a consumer rotates the operating part 200.

A side protrusion piece 204 having a predetermined size is elongated downward from a bottom surface of the operating part 200 at the upper side thereof and is formed on an inner wall part of the accommodating part 201.

The side protrusion piece 204 is provided with a protrusion part 110 that is disposed on the upper side of the sealing part 103 and that protrudes upward near the perforations 102. In addition, the protrusion part 110 is configured to be pushed downward by resistance from the side protrusion piece 204.

The sealing support part 101 disposed around the outer ring-shaped part of the accommodating part 201 and coupled thereto and the sealing part 103 formed inside the sealing support part 101 are configured such that an inner ring-shaped part 104 of the sealing part 103 tightly contacts an inner wall part 206 of the lower end of the accommodating part 201 so as to maintain sealing force thereof.

A connecting part 105 is formed between the sealing support part 101 and the sealing part 103, and the perforations 102 are formed in outer ring-shapes at both sides of the connecting part 105.

The perforations 102 may be provided in the form of recesses or cut gaps, or an auxiliary sealing part such as aluminum foil may be adhered to the lower part of a cut area of the perforations 102.

The perforations 102 are formed in outer ring-shaped parts at both sides of an upper recess 106 of the connecting part 105 and gradually increase in height from the upper recess 106.

The sealing part 103 may protrude upward or be configured such that a sealing surface protrude upward in a circular shape from a plane to seal the inner wall part 206 of the accommodating part 201. The protrusion part 110 is formed on the upper side of the sealing part 103 having a protruding form.

The protrusion part 110 may be close to an area where the perforations 102 start and end, that is, a side area where the upper recess 106 of the connecting part 105 is disposed, and is maximally close to the perforations 102 to form a predetermined circle.

A principle as described above can be applied to a case that the fixed part 100 has a capsule form to be inserted into the operating part 200. In this case, while the operating part 200 is caught and fixed by a wedge-shaped recess formed in an upper end of an inner wall of the container neck, the operating part 200 rotates to break the sealing part 103.

For reference, a main body spout 107 including a main body spout outer ring-shaped protrusion 108 is formed in the upper part of the fixed part 100, and a ring-shaped protrusion 207 of the operating part 200 is disposed around the main body spout 107 and is caught and fixed thereby.

A guide surface 114 is formed on the main body spout outer ring-shaped protrusion 108 formed on the main body spout 107, and has a stepped shape with an inclination angle such that the ring-shaped protrusion 207 moves upward before rotating through 360 degrees without continually rotating.

A guide screw thread 113 is a lower end part of a screw thread 112 disposed above the guide surface 114, and a guide part 209 of the operating part 200 is comparatively opposite to the ring-shaped protrusion 207. Accordingly, while the ring-shaped protrusion 207 contacts the guide surface 114 and moves upward, the guide part 209 enters the guide screw thread 113 such that the operating part 200 is guided out of the main body spout 107 by the screw thread 112.

Figure 5:
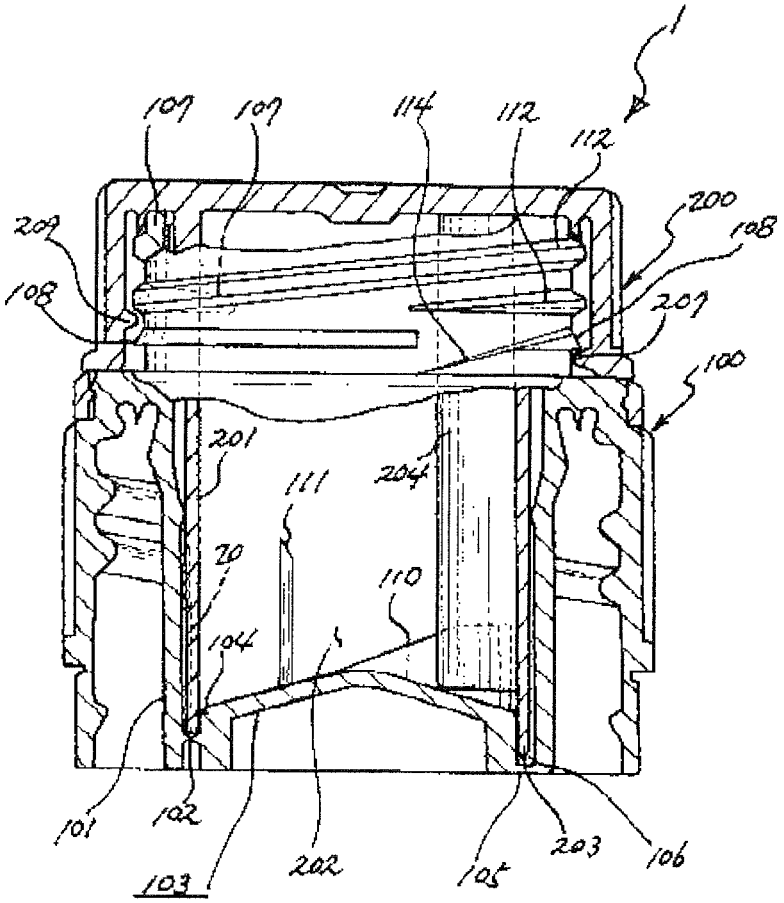
FIG. 5 is a vertical cross-sectional view illustrating an accommodating device according to another embodiment of the present invention.
Figure 6:
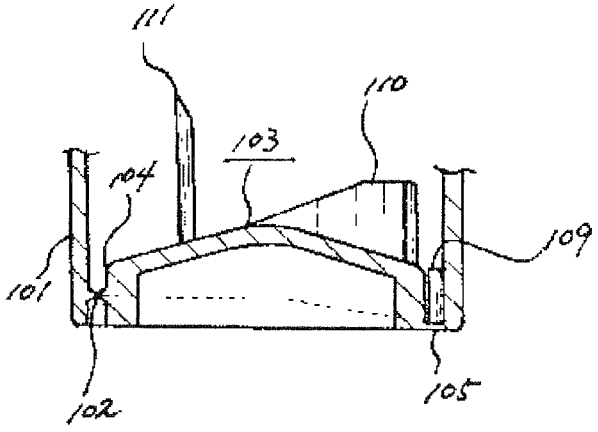
FIG. 6 is a vertical partial cross-sectional view illustrating a principal part of a fixed part of the accommodating device.

In a usage process according to the present invention as described above, when the operating part 200 is rotated in a state as illustrated in FIG. 5, while the tab 203 disposed in the upper recess 106 having a predetermined depth is removed from the upper recess 106, the perforations 102 formed at a predetermined height in the upper recess 106 start to be broken by resistance from the tab 203.

At this point, the lower end part of the side protrusion piece 204 approaches the protrusion part 110 formed on the upper side of the sealing part 103, and then, the protrusion part 110 having a predetermined inclination angle is gradually pushed down by the lower end part of the side protrusion piece 204 to open the storage space 202.

The sealing part 103 that is also opened cannot return upward since the protrusion part 110 is further pushed down by the lower end part of the side protrusion piece 204.

The tab 203 rotates along a circle through an angle approaching about 360 degrees and is then caught by a stopper 109 formed on an inner wall part of the sealing support part 101 around the upper recess 106, so that the tab 203 is prevented from further rotating and is stopped.

For reference, a size or width of the side protrusion piece 204 is adjustable, and the perforations 102 may be shaped from a soft resin through injection molding by a double injection molding device or be shaped by forming a surface of the inner ring-shaped part 104 from a soft resin through double injection molding.

Furthermore, the ring-shaped protrusion 207 of the operating part 200 rotates through predetermined degrees to open the sealing part 103, and the opened sealing part 103 is prevented from returning and is stopped by the catching piece 111.

When the ring-shaped protrusion 207 arrives at the guide surface 114, the ring-shaped protrusion 207 enters the screw thread 112 along the guide surface 114 that is inclined. At this point, the guide part 209 is guided by the guide screw thread 113 and is rotated along the screw thread 112, and simultaneously, the operating part 200 moves out of the fixed part 100 and the main body spout 107.

When the accommodating device 1 configured as described above is used, a mixture contained in the container can be drunk through the main body spout 107 without removing the fixed part 100.

According to another embodiment (refer to FIGS. 7 to 11), an accommodating device 1 for different types of material, which is coupled to a container in a discharge direction of a material contained in the container, includes a fixed part 100 fixed around the inside of a container neck, and an operating part 200 disposed around the fixed part 100 and coupled thereto. An accommodating part 201 having a storage space 202 extends downward within the operating part 200, and the storage space 202 of the accommodating part 201 stores a different type of material such as a liquid, powder, granules, or a tablet.

A hoop 115 of an outer ring-shaped part of the fixed part 100 at the upper end thereof is caught by a coupling protrusion 213 of the operating part 200 and is coupled thereto.

The accommodating part 201 is sealed by a sealing support part 101 and a sealing part 103 of the fixed part 100. The accommodating device 1 is configured such that a tab 203 for breaking perforations, which is formed on a lower end of the accommodating part 201 of the operating part 200, breaks perforations 102 formed between the sealing support part 101 and the sealing part 103 when a consumer rotates the operating part 200. At this point, a protrusion part 110 protruding from the upper side of the sealing part 103 is pushed downward by a side protrusion piece 204 of the operating part 200 so that the different type of material stored in the storage space 202 of the accommodating device 1 falls into the container and undergoes a mixing process.

The sealing part 103 tightly contacts the lower end part of the accommodating part 201 of the operating part 200, or an upwardly protruding dome shape seals the lower end part of the accommodating part 201. Alternatively, the sealing part 103 may be inserted in an inner wall part of the accommodating part 201 as the lower end thereof, thereby sealing the lower end part of the accommodating part 201.

Figure 7:
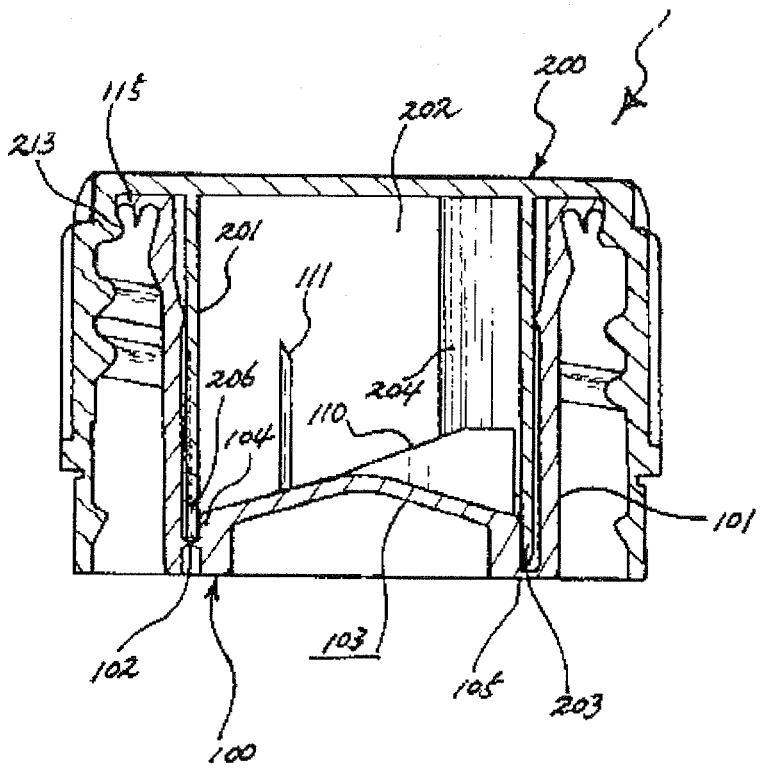
FIG. 7 is a vertical cross-sectional view illustrating an accommodating device according to another embodiment of the present invention.

In a usage process according to the current embodiment, when the accommodating device 1 is coupled to the container neck in a state as illustrated in FIG. 7, an operating part wedge 211 catches a fixed part wedge 116 and is integrally coupled thereto (refer to FIG. 9), thereby coupling to the container neck. At this point, an operating part outer wedge 212 unresistingly goes over a wedge type catching part 1001 vertically formed on an inner wall part of the container neck (refer to FIG. 10).

When the operating part 200 is reversely rotated, since the operating part outer wedge 212 is caught by the wedge type catching part 1001, the fixed part 100 moves upward without rotation. At this point, the accommodating part 201 rotates together with the operating part 200, and simultaneously, the tab 203 disposed on the lower end part of the accommodating part 201 breaks the perforations 102.

Figure 11:
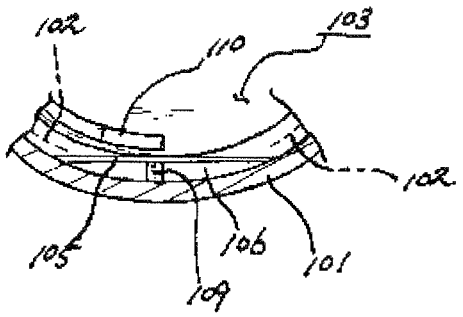
FIG. 11 is a horizontal cross-sectional view illustrating principal parts of the sealing support part of FIG. 8 and the sealing part.

More particularly, referring to FIG. 11, the tab 203 disposed in an upper recess 106 rotates in a direction away from a stopper 109, and simultaneously, breaks the perforations 102 that gradually increase in height toward a higher position than the upper recess 106. Then, when the tab 203 meets the protrusion part 110 formed above the sealing part 103, the side protrusion piece 204 formed on the inner wall part of the accommodating part 201 of the operating part 200 pushes the protrusion part 110 to open the storage space 202 as illustrated in FIG. 8.

At this point, an inner ring-shaped part 104 tightly contacting an inner wall part 206 moves along a circle about a connecting part 105 to space at least one portion of the sealing part 103 apart from the inner wall part 206, and simultaneously, the different type of material falls from the storage space 202 of the accommodating part 201 (when the accommodating device 1 is coupled to the container) and undergoes the mixing process.

Figure 8:
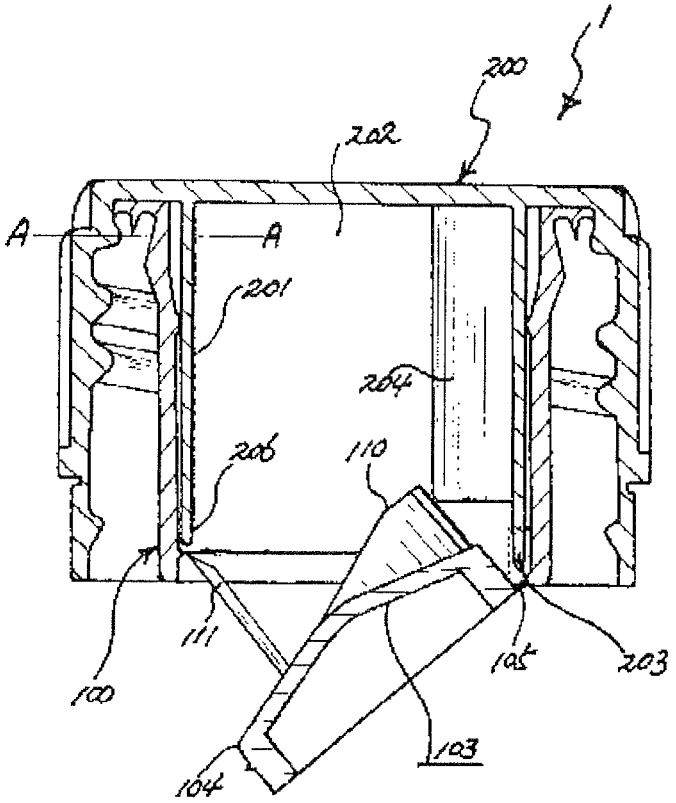
FIG. 8 is a vertical cross-sectional view illustrating a state in which a sealing part of the accommodating device of FIG. 7 is opened.

While the sealing part 103 is spaced apart from the inner wall part 206, a catching piece 111 is caught by the lower end of the inner wall part 206 or the lower end of the sealing support part 101 and is thus fixed without returning to an original position thereof, which is partially illustrated in FIG. 8.

Figure 9:
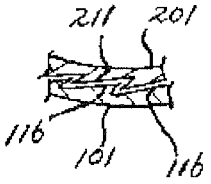
FIG. 9 is a cross-sectional view taken along line A-A of FIG. 8, which illustrates a coupling relationship between a sealing support part and an accommodating part.
Figure 10:
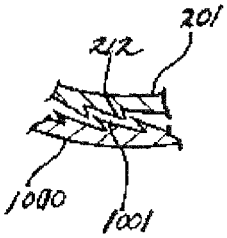
FIG. 10 is a horizontal cross-sectional view illustrating a coupling relationship between principal parts of the accommodating part and a container.

Referring to FIG. 9, when the accommodating part 201 rotates clockwise, the operating part wedge 211 is caught by the fixed part wedge 116, so that the accommodating part 201 and the sealing support part 101 integrally move. However, referring to FIG. 10, when the accommodating part 201 rotates counterclockwise, the operating part outer wedge 212 formed on an outer ring-shaped part of the sealing support part 101 is caught by the wedge type catching part 1001 of the container to fix the sealing support part 101.

The fixed part wedge 116, the operating part wedge 211, or the operating part outer wedge 212 may be intermittently repeated or repeated at regular intervals through a design change.

According to another embodiment (refer to FIG. 12), an accommodating device 1 for different types of material, which is coupled to a container in a discharge direction of a material contained in the container, includes a fixed part 100 fixed around the inside of a container neck, and an operating part 200 disposed around the fixed part 100 and coupled thereto. An accommodating part 201 having a storage space 202 extends downward within the operating part 200, and the storage space 202 of the accommodating part 201 stores a different type of material such as a liquid, powder, granules, or a tablet.

A hoop 115 of an outer ring-shaped part of the fixed part 100 at the upper end thereof is firmly caught by a coupling protrusion 213 of the operating part 200 and is fixedly coupled thereto. The accommodating part 201 is sealed by the sealing support part 101 and the sealing part 103 of the fixed part 100. The accommodating device 1 is configured such that a tab 203 for breaking perforations, which is formed on the lower end of the accommodating part 201 of the operating part 200, breaks perforations 102 formed between the sealing support part 101 and the sealing part 103 when a consumer rotates the operating part 200.

At this point, a protrusion part 110 protruding from the upper side of the sealing part 103 is pushed downward by a side protrusion piece 204 of the operating part 200 so that the different type of material stored in the storage space 202 of the accommodating device 1 falls into the container and undergoes a mixing process. The upper end of the accommodating part 201 extends upward, and an outer ring-shaped part of the accommodating part 201 is divided by separating perforations 214 such that the outer ring-shaped part is separated from a portion of the operating part 200.

The sealing part 103 is fitted in an inner wall part of the accommodating part 201 at the lower end part thereof, thereby sealing the storage space 202 of the accommodating part 201. For example, a surface of the sealing part 103 may protrude upward in a dome shape to seal the inner wall part of the accommodating part 201.

The separating perforations 214 are formed at the inside of the operating part 200, where the coupling protrusion 213 is disposed, such that the hoop 115 formed on the outer ring-shaped part of the fixed part 100 is prevented from being removed from the coupling protrusion 213 of the operating part 200.

A fixing protrusion 215 is formed on the outer ring-shaped part of the accommodating part 201 and is disposed around an inner wall part of the fixed part 100 and coupled thereto. A tap or a handle 208 having two or more protruding surfaces is formed on an upper outer ring-shaped part of the operating part 200. If necessary, a figure, such as a miniature or character, or a protruding member having a recess may be provided on the handle 208, or be separately manufactured and be then coupled thereto. Such a figure or protruding member may provide an anti-slip function when the operating part 200 is opened.

Figure 12:
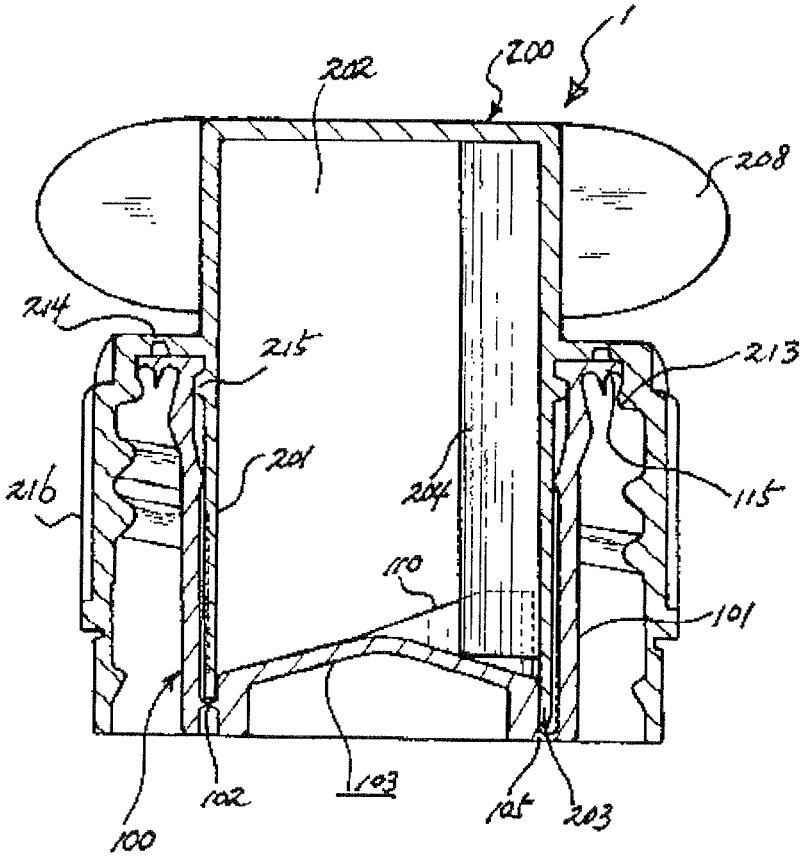
FIG. 12 is a vertical cross-sectional view illustrating an accommodating device according to another embodiment of the present invention.

A usage state of the accommodating device 1 as illustrated in FIG. 12 will now be described.

The accommodating device 1 as illustrated in FIG. 12 may be coupled to the container neck. In this state, when the handle 208 of the operating part 200 is held and rotated clockwise, the tab 203 breaks the perforations 102. Before the tab 203 makes one revolution, while the side protrusion piece 204 pushes the protrusion part 110, the sealing part 103 is opened. At this point, the different type of material falls from the storage space 202 and undergoes a mixing process.

Also at this point, a side part 216 of the operating part 200 is closely fixed to the container. When the handle 208 of the operating part 200 is rotated, the separating perforations 214 are broken.

Although the separating perforations 214 are broken, the fixing protrusion 215 is caught by a part such as a recess or a protrusion formed on at least one portion of the inner wall part of the fixed part 100. Thus, the accommodating part 201 is not removed from the fixed part 100 under any circumstances.

INDUSTRIAL APPLICABILITY

A device according to the present invention is applied to a beverage or alcohol container, specifically, can be used as a bottle cap finishing device configured such that a separately stored different type of material is immediately mixed with a material contained in a container.

The invention claimed is:

1. An accommodating device for different types of material, which is coupled to a container in a discharge direction of a material contained in the container, the accommodating device comprising a fixed part fixed around a container neck, and an operating part disposed around the fixed part and coupled thereto, wherein: an accommodating part having a storage space extends downward within the operating part; the storage space of the accommodating part stores a different type of material; a lower end part and an outer ring-shaped part of the accommodating part are sealed by a sealing support part and a sealing part of the fixed part disposed around the container neck and coupled thereto; a tab for breaking perforations, which is formed on a lower end of the accommodating part of the operating part, breaks perforations formed between the sealing support part and the sealing part when a consumer rotates the operating part; during the breakage of the perforations, a protrusion part protruding from the upper side of the sealing part is pushed downward by a side protrusion piece of the operating part extending inwardly on an innermost wall of the accommodating part so that the different type of material stored in the storage space of the accommodating device falls into the container and undergoes a mixing process; and the sealing support part disposed around the outer ring-shaped part of the accommodating part and coupled thereto and the sealing part formed inside the sealing support part are configured such that an inner ring-shaped part of the sealing part tightly contacts an inner wall part of the lower end of the accommodating part so as to maintain sealing force thereof.

2. The accommodating device of claim 1, wherein a stop piece protrudes a predetermined length above the sealing part.

3. The accommodating device of claim 2, wherein an end part of the stop piece is caught and fixed by the sealing support part or the lower end part of the accommodating part.

4. An accommodating device for different types of material, which is coupled to a container in a discharge direction of a material contained in the container, the accommodating device comprising a fixed part fixed around a container neck, and an operating part disposed around the fixed part and coupled thereto, wherein: an accommodating part having a storage space extends downward within the operating part; the storage space of the accommodating part stores a different type of material; a lower end part and an outer ring-shaped part of the accommodating part are sealed by a sealing support part and a sealing part of the fixed part disposed around the container neck and coupled thereto; a tab for breaking perforations, which is formed on a lower end of the accommodating part of the operating part, breaks perforations formed between the sealing support part and the sealing part when a consumer rotates the operating part; during the breakage of the perforations, a protrusion part protruding from the upper side of the sealing part is pushed downward by a side protrusion piece of the operating part extending inwardly on an innermost wall of the accommodating part so that the different type of material stored in the storage space of the accommodating device falls into the container and undergoes a mixing process; a main body spout outer ring-shaped protrusion is disposed on an outer ring-shaped part of a main body spout at a lower end part thereof; a guide surface having an inclined shape is disposed on a portion of the main body spout outer ring-shaped protrusion; and a screw thread having a guide screw thread is formed above the guide surface.

5. The accommodating device of claim 4, wherein: the operating part includes a ring-shaped protrusion and a guide part; and while the ring-shaped protrusion caught by the main body spout outer ring-shaped protrusion rotates along a predetermined circle and is then moved upward by resistance from a guide surface, the guide part rotates on the guide screw thread along the screw thread, and simultaneously, the operating part moves out of the main body spout.

6. An accommodating device for different types of material, which is coupled to a container in a discharge direction of a material contained in the container, the accommodating device comprising a fixed part fixed around the inside of a container neck, and an operating part disposed around the fixed part and coupled thereto, wherein: an accommodating part having a storage space extends downward within the operating part; the storage space of the accommodating part stores a different type of material; a hoop of an outer ring-shaped part of the fixed part at an upper end thereof is caught by a coupling protrusion of the operating part and is coupled thereto; the accommodating part is sealed by a sealing support part and a sealing part of the fixed part; a tab for breaking perforations, which is formed on a lower end of the accommodating part of the operating part, breaks perforations formed between the sealing support part and the sealing part when a consumer rotates the operating part; during the breakage of the perforations, a protrusion part protruding from the upper side of the sealing part is pushed downward by a side protrusion piece of the operating part extending inwardly on an innermost wall of the accommodating part so that the different type of material stored in the storage space of the accommodating device falls into the container and undergoes a mixing process; and the sealing part tightly contacts and seals a lower end part of the accommodating part of the operating part.

7. The accommodating device of claim 6, wherein the sealing part is inserted in an inner wall part of the accommodating part as the lower end thereof, thereby sealing the lower end part of the accommodating part.

8. An accommodating device for different types of material, which is coupled to a container in a discharge direction of a material contained in the container, the accommodating device comprising a fixed part fixed around the inside of a container neck, and an operating part disposed around the fixed part and coupled thereto, wherein: an accommodating part having a storage space extends downward within the operating part; the storage space of the accommodating part stores a different type of material; a hoop of an outer ring-shaped part of the fixed part at an upper end thereof is caught by a coupling protrusion of the operating part and is fixedly coupled thereto; the accommodating part is sealed by a sealing support part and a sealing part of the fixed part; a tab for breaking perforations, which is formed on a lower end of the accommodating part of the operating part, breaks perforations formed between the sealing support part and the sealing part when a consumer rotates the operating part; during the breakage of the perforations, a protrusion part protruding from the upper side of the sealing part is pushed downward by a side protrusion piece of the operating part extending inwardly on an innermost wall of the accommodating part so that the different type of material stored in the storage space of the accommodating device falls into the container and undergoes a mixing process; and an upper end of the accommodating part extends upward, and an outer ring-shaped part of the accommodating part is divided by separating perforations such that the outer ring-shaped part is separated from a portion of the operating part.

9. The accommodating device of claim 8, wherein the sealing part is fitted in an inner wall part of the accommodating part at a lower end part thereof, thereby sealing the storage space of the accommodating part.

10. The accommodating device of claim 8, wherein the separating perforations are formed at the inside of the operating part, where the coupling protrusion is disposed, such that the hoop formed on the outer ring-shaped part of the fixed part is prevented from being removed from the coupling protrusion of the operating part.

11. The accommodating device of claim 8, wherein a fixing protrusion is formed on the outer ring-shaped part of the accommodating part and is disposed around an inner wall part of the fixed part and coupled thereto.

12. The accommodating device of claim 8, wherein a handle having two or more protruding surfaces or a tap is formed on an upper outer ring-shaped part of the operating part.

13. The accommodating device of claim 8, wherein the accommodating part extends upward, and various figures are assembled on or coupled to an upper outer ring-shaped part of the accommodating part.

14. The accommodating device of claim 1, wherein the material is a liquid, a powder, granules, or a tablet.

15. The accommodating device of claim 4, wherein the material is a liquid, a powder, granules, or a tablet.

16. The accommodating device of claim 6, wherein the material is a liquid, a powder, granules, or a tablet.

17. The accommodating device of claim 8, wherein the material is a liquid, a powder, granules, or a tablet.

18. The accommodating device of claim 13, wherein the various figures is a miniature or a character.

* * * * *